US007297891B2

(12) United States Patent
Omori et al.

(10) Patent No.: US 7,297,891 B2
(45) Date of Patent: Nov. 20, 2007

(54) TRIGGER SWITCH

(75) Inventors: Koji Omori, Takatsuki (JP); Yoshiyuki Baba, Hikone (JP)

(73) Assignee: Omron Corporation, Kyoto (JP)

( * ) Notice: Subject to any disclaimer, the term of this patent is extended or adjusted under 35 U.S.C. 154(b) by 0 days.

(21) Appl. No.: 11/416,403

(22) Filed: May 2, 2006

(65) Prior Publication Data

US 2006/0243775 A1 Nov. 2, 2006

(30) Foreign Application Priority Data

May 2, 2005 (JP) ..... 2005-134203

(51) Int. Cl.
*H01H 13/02* (2006.01)

(52) U.S. Cl. ..... 200/522

(58) Field of Classification Search ..... 200/520, 200/522, 61.85, 293.1, 329, 332.1, 332.2; 173/170; 310/50; 361/704
See application file for complete search history.

(56) References Cited

U.S. PATENT DOCUMENTS 3,413,498 A * 11/1968 Bowen, III et al. ..... 310/47
4,565,912 A * 1/1986 Glenn ..... 200/522
4,660,019 A * 4/1987 Bauer et al. ..... 338/179
4,698,471 A * 10/1987 Piber ..... 200/302.2
5,198,793 A * 3/1993 Leveque ..... 338/172
5,380,971 A * 1/1995 Bittel et al. ..... 200/536
6,727,450 B2 * 4/2004 Schaeffeler et al. ..... 200/522
6,784,390 B2 * 8/2004 Chu ..... 200/522
6,794,594 B2 * 9/2004 Ching ..... 200/522

FOREIGN PATENT DOCUMENTS

JP 10-69838 3/1998

OTHER PUBLICATIONS

Patent Abstracts of Japan, Publication No. 10-069838; Publication Date: Mar. 10, 1998, 30 pages.

* cited by examiner

*Primary Examiner*—Michael A Friedhofer
(74) *Attorney, Agent, or Firm*—Osha Liang LLP

(57) ABSTRACT

A trigger switch has a stationary contact and a moving contact provided inside a body and able to come close to and away from each other a contact drive member accommodated slidably inside the body to drive the moving contact, and an operating shaft having a first end engaging with the contact drive member and a second end which projects from the body, having a trigger configured to be operated by a user. Clearance is provided between the first end of the operating shaft and the contact drive member upon engagement, which enables inclination of the operating shaft relative to the contact drive member.

7 Claims, 6 Drawing Sheets

(A)

(B)

(C)

TRIGGER SWITCH

BACKGROUND OF THE INVENTION

1. Field of the Invention

The present invention relates to a trigger switch used for power tools.

2. Background Art

There are widely used trigger switches mounted on a grip of an power tool or the like and enabling the power tool to be started when a user puts a finger thereon to pull in the same.

As described in JP-A-10-69838, in conventional trigger switches, a contact drive part provided on one end of an operating shaft with a trigger on the other end drives a moving contact to cause the moving contact to come into pressure contact or away from a stationary contact, whereby the circuit is closed and opened.

However, power tools are frequently handled roughly, and an impact force in a bending direction often acts on an operating shaft to cause a danger that the operating shaft is broken at a base end thereof toward a contact drive part. Therefore, with conventional trigger switches, a contact drive part is formed integral with an operating shaft and a trigger is fixed to the an operating shaft afterward in order to ensure a strength for a base end of the operating shaft, on which an external force is liable to be concentrated. Also, the operating shaft is normally biased in a manner to project outward (toward a trigger). Therefore, when a user pulls a trigger with a finger and quickly separates a finger from the trigger from a state, in which the operating shaft is pushed in, the operating shaft is rapidly moved to cause a fear that the trigger is disengaged by an impact at that time, so that it is also necessary to fix the trigger to the operating shaft firmly.

Also, since power tools are frequently used in an environment with much dust, trigger switches are demanded to have a dustproof construction, in which dust does not enter inside. Since an operating shaft comes in and out of a trigger switch, an air having a volume equal to that of the operating shaft, which comes in and out, comes in and out of the trigger switch. Such entrance and exit of an air causes a danger of carrying dust into the switch, it is not preferable to make the operating shaft thick, which degrades the dustproof property of a trigger switch. Also, when an operating shaft is made metallic in order to heighten its strength, design becomes difficult since there is a danger of short-circuiting of an electric circuit inside a trigger switch.

As described above, conventional trigger switches involve a problem that when the dustproof capacity is ensured, an operating shaft is not adequate in strength and in some cases broken by an impact.

SUMMARY OF THE INVENTION

Hereupon, it is an object of the invention to provide a trigger switch, of which an operating shaft is not broken by an impact force.

In order to solve the problem, the invention provides a trigger switch comprising a stationary contact and a moving contact, which are provided inside a body to be able to come close to and away from each other, a contact drive member accommodated slidably inside the body to drive the moving contact, and an operating shaft having one end thereof engaging with the contact drive member and provided on the other end thereof, which projects from the body, with a trigger, which a user operates, and wherein the operating shaft is put in an engagement state of having play, which enables inclination relative to the contact drive member.

With such construction, the contact drive member and the operating shaft are separate from each other and play is provided between the both, so that even when an impact is applied to a trigger, it is possible to lessen a bending stress on the operating shaft. Therefore, there does not occur any trouble that the operating shaft is broken.

Also, with the trigger switch of the invention, the body may be protrusively provided with a guide, which guides the trigger in an axial direction, and a maximum angle of inclination of the operating shaft afforded by the play may be made larger than an inclination of the operating shaft allowed by the guide.

With such construction, the guide bears an external force applied on the trigger and an impact load is not applied to the operating shaft and the contact drive member, so that the operating shaft and the contact drive member are not broken.

Also, with the trigger switch of the invention, the contact drive member may comprise a wall portion substantially perpendicular to the operating shaft to be provided with a notch, and the operating shaft may be provided with an engagement groove, which engages with the notch.

With such construction, it is easy to provide play between the operating shaft and the contact drive member. Also, a trigger switch can be assembled by engaging the contact drive member with the operating shaft, which is arranged in a predetermined position, in a direction perpendicular to an axis, and assembly is also made possible by forming a drive shaft and a trigger integrally.

Also, with the trigger switch of the invention, a maximum angle of inclination afforded by the play may be made not less than 1° but not more than 5°.

When a maximum angle of inclination afforded by the play is not less than 1°, it is possible to ensure a sufficient play, which eliminates application of an impact to the operating shaft. Also, when a maximum angle of inclination afforded by the play is not more than 5°, a trigger does not suffer from rattling, which makes a user get a sense of incongruity.

As described above, with the trigger switch of the invention, the contact drive member and the operating shaft are separate from each other and play is provided between the both, so that even when an impact is applied to a trigger, any large force does not act directly on the operating shaft and the operating shaft is not broken. Also, since any large force does not act directly on the operating shaft, it is not necessary to increase a shaft diameter and a trigger switch is realized, which is excellent in dustproof property.

DETAILED DESCRIPTION OF THE INVENTION

An embodiment of the invention will be described below with reference to the drawings.

Figure 1:
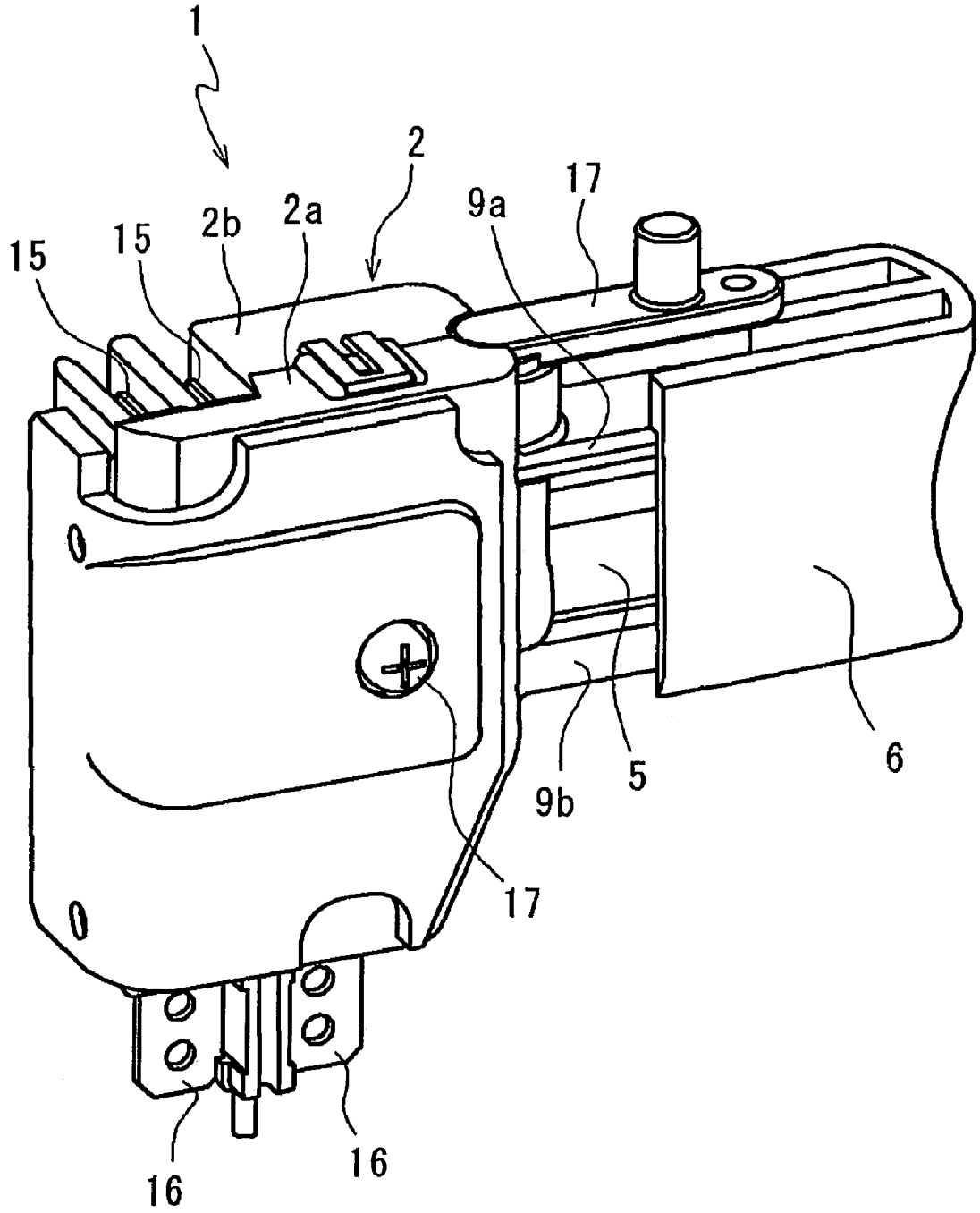
FIG. 1 is a perspective view showing a trigger switch according to an embodiment of the invention.
Figure 2:
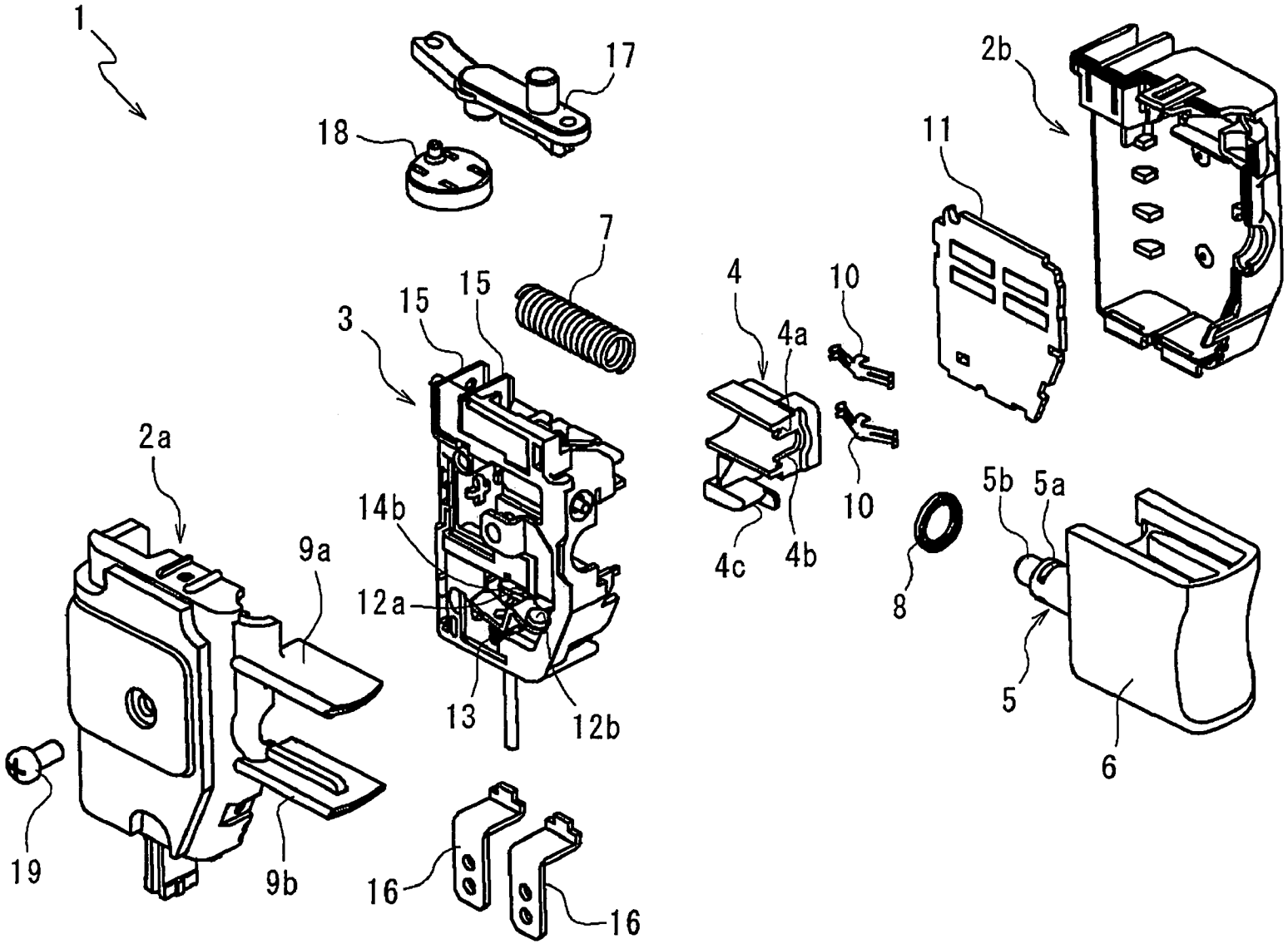
FIG. 2 is an exploded, perspective view showing the trigger switch of FIG. 1.
Figure 3:
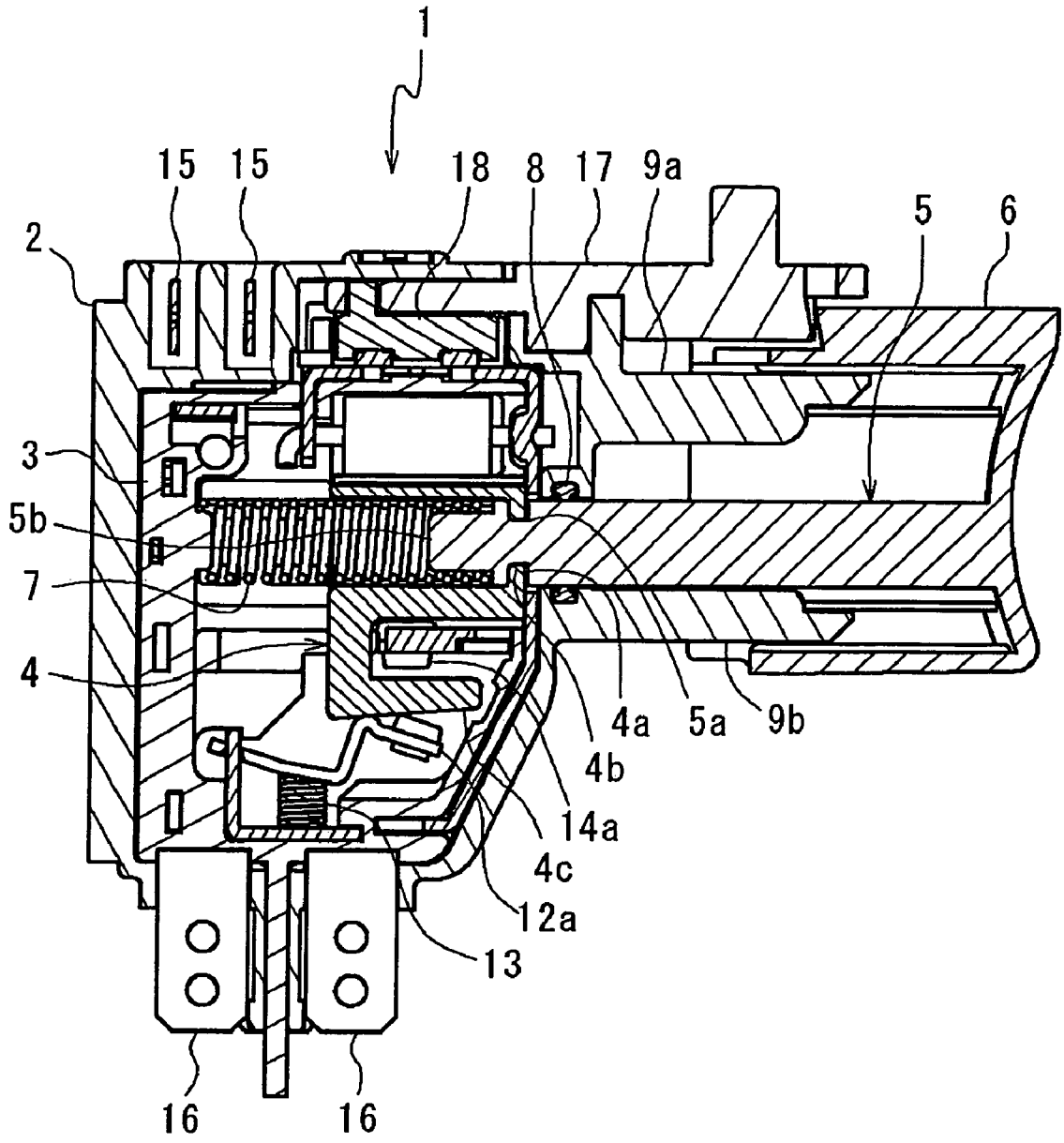
FIG. 3 is a cross sectional view showing the trigger switch of FIG. 1.
Figure 5:
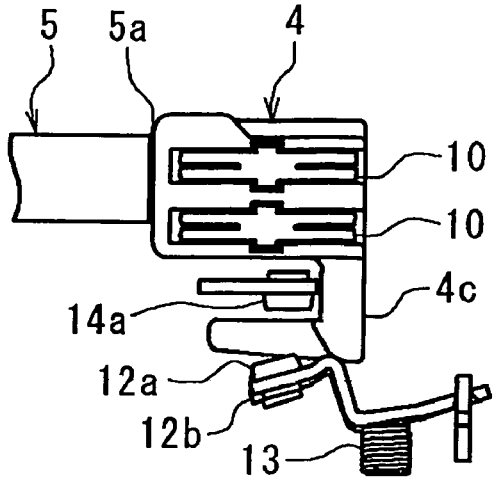
FIG. 5 is a side view showing the relationship between the contact drive member, and moving and stationary contacts in FIG. 1.
Figure 5:
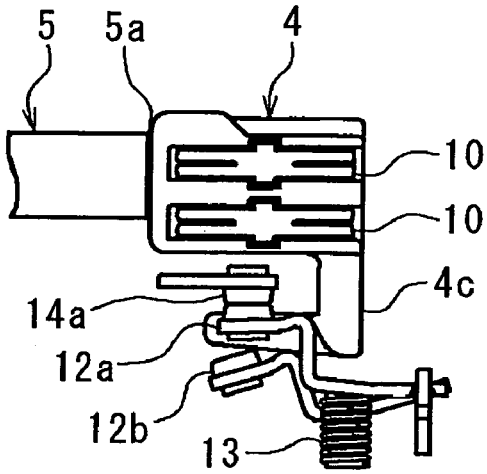
Figure 5:
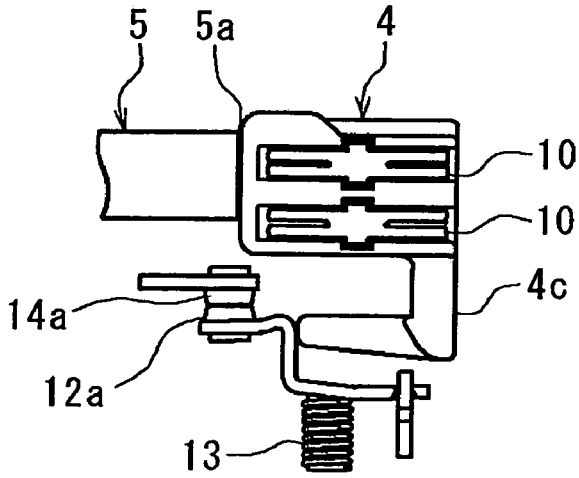

FIG. 1 shows a trigger switch 1 according to an embodiment of the invention, and FIGS. 2 and 3 are an exploded, perspective view and a cross sectional view showing the trigger switch 1. The trigger switch 1 comprises a switch assembly 3 accommodated in an internal space of a body 2 composed of a right cover 2*a* and a left cover 2*b*. The switch assembly 3 comprises a contact drive member 4, and the contact drive member 4 engages with an operating shaft 5, which extends outside the body 2. A trigger 6 is formed at an outer end of the operating shaft 5 to be made integral with the operating shaft 5 so that a user put a finger on the trigger to pull the operating shaft 5 into the body 2. The contact drive member 4 and the operating shaft 5 are biased by a return spring 7 in a direction, in which the operating shaft 5 is pushed outside the body 2. Arranged on the trigger switch 1 is a dustproof ring 8 that seals a gap between the operating shaft 5 and an opening of the body 2, through which the operating shaft 5 extends. The trigger 5 is moved along guides 9*a*, 9*b* provided on the body 2 in an axial direction of the operating shaft 5. The contact drive member 4 is provided, as shown in FIG. 5, with two slide contacts 10, and axially moved to slide the slide contacts 10 on a surface of a terminal plate 11 and to drive two moving contacts 12*a*, 12*b* to cause the same to cooperate with contact springs 13 to come into pressure contact with or away from two stationary contacts 14*a*, 14*b* (In addition, the stationary contact 14*b* is positioned interiorly of the stationary contact 14*a* and so not shown). The switch assembly 3 is positioned in an upper portion of the body 2 as shown in FIG. 3, and provided with motor terminals 15, to which feeders to a motor are connected, and power source terminals 16, which are protruded from the lower portion of the main body 2 and are connected to an electric power source. In the switch assembly 3, the moving contacts 12*a*, 12*b* are connected to the motor terminals 15 and the stationary contacts 14*a*, 14*b* are connected to the power source terminals 16, so that the moving contacts 12*a*, 12*b* abut against the stationary contacts 14*a*, 14*b* to enable supplying electricity to the motor. Also, connection to the motor terminals 15 can be switched in phase by a rotary switch 18, which is driven by a switchover lever 17. The right cover 2*a* and the left cover 2*b* are fixed by means of screws 19.

Figure 4:
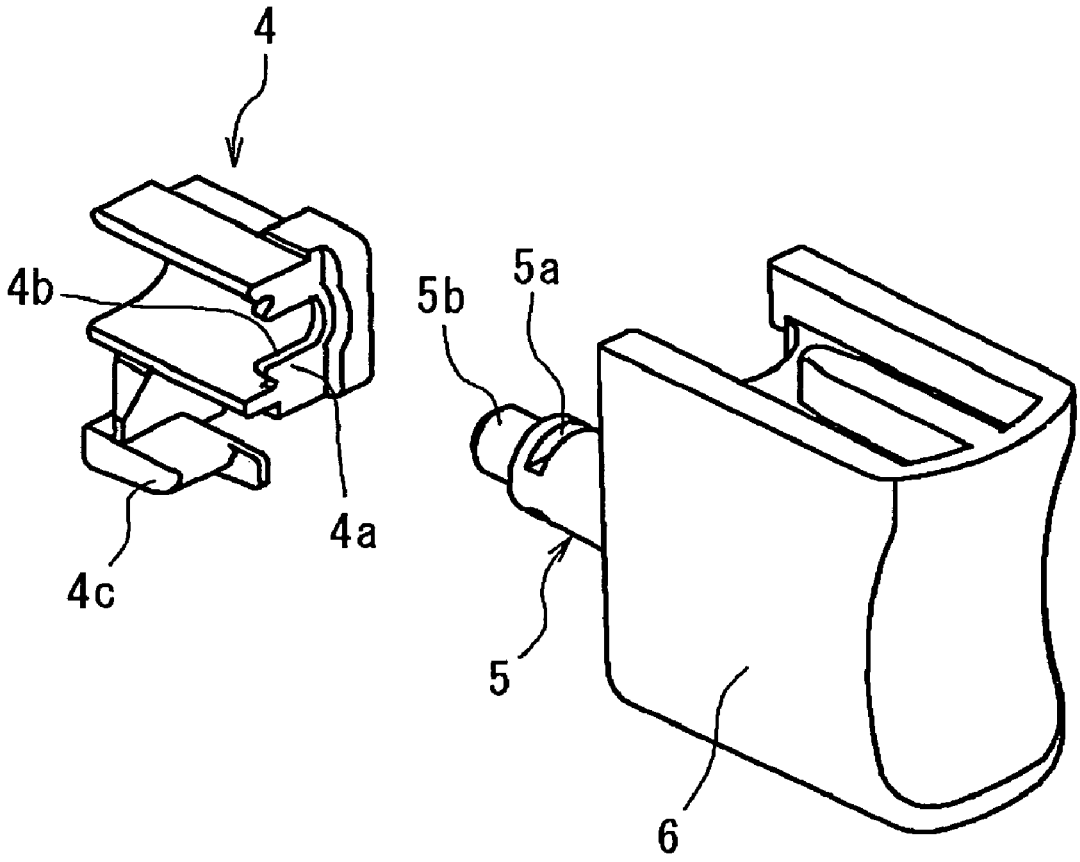
FIG. 4 is an enlarged, perspective view showing a contact drive member and an operating shaft in FIG. 1.

FIG. 4 show, in enlarged scale, the contact drive member 4, the operating shaft 5, and the trigger 6, and the contact drive member 4 and the operating shaft 5 will be described in detail. The contact drive member 4 has a wall portion 4*a* (having a thickness of, for example, 1.0 mm) perpendicular to the operating shaft 5, the wall portion 4*a* being provided with a U-shaped notch 4*b*, which has a smaller width (having a width of, for example, 2.9 mm) than a diameter (having a diameter of, for example, 5.5 mm) of the operating shaft 5. Also, the contact drive member 4 is protrusively provided with a drive portion 4*c*, against which the moving contacts 12*a*, 12*b* abut. On the other hand, the operating shaft 5 is provided at a barrel portion thereof near an axial end thereof with an engagement groove 5*a*, which is perpendicular to an axial direction to engage with the notch 4*b*, and provided at an end thereof with a seat portion 5*b*, with which the return spring 7 engages. The engagement groove 5*a* is formed to be considerably wider (for example, 1.2 mm) than a thickness of the wall portion 4*a* and to make a thickness of the operating shaft 5 locally smaller (for example, 2.8 mm) than a width of the notch 4*b*. The wall portion 4*a* around the notch 4*b* of the contact drive member 4 is fitted into the engagement groove 5*a* of the operating shaft 5 whereby the operating shaft 5 and the contact drive member 4 are connected to each other with play therebetween to be made movable together in an axial direction.

Subsequently, an operation of the trigger switch 1 will be described.

FIG. 5 shows only those constituent elements, which are related to a main operation of the trigger switch, for the convenience of understanding. FIG. 5(A) shows a state, in which a user does not put a finger on the trigger 6. The operating shaft 5 is caused by the return spring 7 to project to a maximum extent from the body 2, and the drive portion 4*c* of the contact drive member 4 pushes down the two moving contacts 12*a*, 12*b* against the bias of the contact springs 13 to separate the moving contacts 12*a*, 12*b* from the stationary contacts 14*a*, 14*b*. The drive portion 4*c* has a short portion thereof abutting against the moving contact 12*a* on this side in the figure and has a long portion thereof abutting against the moving contact 12*b* on the back side in the figure.

As shown in FIG. 5B, when a user pulls in the trigger 6 slightly, the contact drive member 4 moves, so that the moving contact 12*a* on this side first disengages from the drive portion 4*c* and is caused by the contact springs 13 to abut against the stationary contact 14*a*. The stationary contact 14*a*, against which the moving contact 12*a* abuts, is connected to the motor terminal 15 through a control circuit, which restricts an electric current according to a position of the slide contact 10, and output to the motor is controlled according to an amount, by which the trigger 6 is pulled in, in a state shown in FIG. 5B.

Further, when the trigger 6 is pulled and the operating shaft 5 is pushed into the interior of the body 2, the drive portion 4*c* of the contact drive member 4 also disengages from the moving contact 12*b* on the back side in the figure and the moving contact 12*b* on the back side abuts against the corresponding stationary contact 14*b* as shown in FIG. 5C. The stationary contact 14*b* on the back side (behind 14*a*) is connected directly to the motor terminal 15 to apply a maximum electric current to the motor.

When a user relaxes a pulling force for the trigger 6, the contact drive member 4 and the operating shaft 5 are pushed back by the return spring 7 to go through a state of FIG. 5B to return to a state of FIG. 5C. Thereby, the motor becomes slow in rotation and stops.

Figure 6:
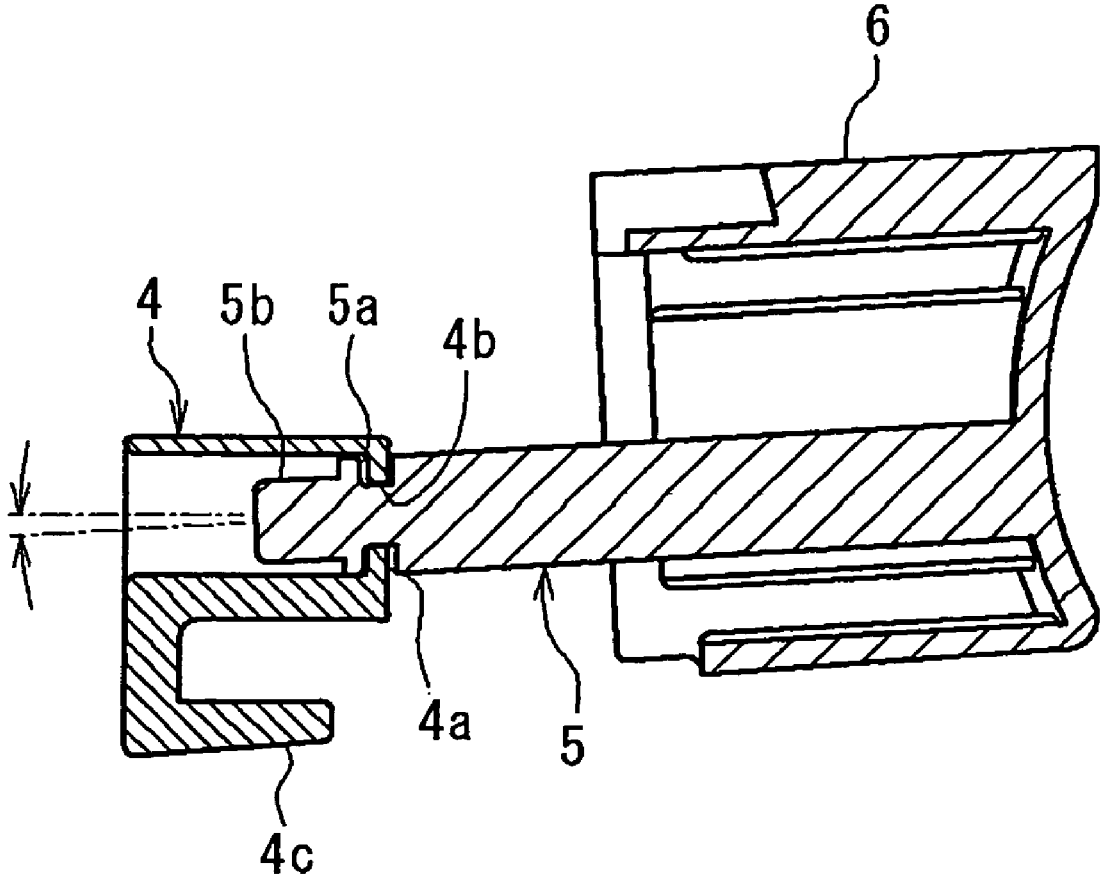
FIG. 6 is a cross sectional view showing the contact drive member and the operating shaft in FIG. 1.

Subsequently, an explanation will be given to an effect produced by an engaging structure of the contact drive member 4 of the trigger switch 1 and the operating shaft 5. FIG. 6 shows a possible state, in which the contact drive member 4 and the operating shaft 5 engage with each other. Since the operating shaft 5 has play relative to the contact drive member 4, a maximum inclination of 5° relative to the contact drive member 4 is possible in an engaged state as shown in the figure. The play between the contact drive member 4 and the operating shaft 5 is one obtained by sizing the contact drive member 4 and the operating shaft 5 so that they can be formed by an ordinary injection molding and assembled easily. On the other hand, the trigger 6 is restricted in movement by the guides 9*a*, 9*b* with the result that inclination of the operating shaft 5 is limited. Therefore, the guides 9*a*, 9*b* guide the trigger 6 to thereby enable maintaining an inclination of the operating shaft 5 at less than 5°.

The trigger switch 1 is designed such that the operating shaft 5 is thin and the dustproof ring 8 prevents dust and dirt from entering the body 2. On the other hand, since the guides

9*a*, 9*b* do not affect the dustproof function, they are designed to be thick and strong so as to get a sufficient strength and have a sufficient strength to be free from rupture by a shock.

Therefore, in the case where an external force in a different direction from a direction, in which the operating shaft 5 is moved, is tentatively applied to the trigger 6, the force applied to the trigger 6 is born by the guides 9*a*, 9*b*. On the other hand, the operating shaft 5 together with the trigger 6 is inclined relative to the contact drive member 4 to absorb and relax an external force, so that there is no fear of rupture.

The tentative provision of play such that an inclination of the operating shaft 5 relative to the contact drive member 4 exceeds 5° is not preferable since a user gets a sense of incongruity or feels uneasy. Also, while the trigger 6 is restricted in movement by the guides 9*a*, 9*b*, a processing accuracy obtained by ordinary resin molding cannot but help allowing an inclination of the operating shaft 5 in the order of 1° in order to enable the trigger 6 to move smoothly along the guides 9*a*, 9*b*. Therefore, when an inclination allowed by play between the contact drive member 4 and the operating shaft 5 is less than 1°, there is a fear that it is not possible to sufficiently absorb and relax an external force applied to the trigger 6.

What is claimed is:

1. A trigger switch comprising:

a stationary contact and a moving contact, provided inside a body and able to come close to and away from each other, a contact drive member accommodated slidably inside the body to drive the moving contact, and an operating shaft having a first end engaging with the contact drive member and a second end which projects from the body, having a trigger configured to be operated by a user, wherein clearance is provided between the first end of the operating shaft and the contact drive member upon engagement, which enables inclination of the operating shaft relative to the contact drive member.

2. The trigger switch according to claim 1, wherein a maximum angle of inclination allowed by the clearance between the first end of the operating shaft and the contact drive member is not less than 1° but not more than 5°.

3. A trigger switch comprising:

a stationary contact and a moving contact provided inside a body and able to come close to and away from each other, a contact drive member accommodated slidably inside the body to drive the moving contact, and an operating shaft having a first end engaging in with the contact drive member and a second end which projects from the body, having a trigger configured to be operated by a user, wherein clearance is provided between the first end of the operating shaft and the contact drive member upon engagement, which enables inclination of the operating shaft relative to the contact drive member, and wherein the body is protrusively provided with a guide, which guides the trigger in an axial direction, and a maximum angle of inclination of the operating shaft allowed by the clearance between the first end of the operating shaft and the contact drive member is larger than an inclination of the operating shaft allowed by the guide.

4. The trigger switch according to claim 3, wherein the contact drive member comprises a wall portion substantially perpendicular to the operating shaft and provided with a notch, and the operating shaft is provided with an engagement groove, which engages with the notch.

5. The trigger switch according to claim 3, wherein a maximum angle of inclination allowed by the clearance between the first end of the operating shaft and the contact drive member is not less than 1° but not more than 5°.

6. A trigger switch comprising:

a stationary contact and a moving contact provided inside a body and able to come close to and away from each other, a contact drive member accommodated slidably inside the body to drive the moving contact, and an operating shaft having a first end engaging with the contact drive member and a second end which projects from the body, having a trigger configured to be operated by a user, wherein clearance is provided between the first end of the operating shaft and the contact drive member upon engagement, which enables inclination of the operating shaft relative to the contact drive member, and wherein the contact drive member comprises a wall portion substantially perpendicular to the operating shaft and provided with a notch, and the operating shaft is provided with an engagement groove which engages with the notch.

7. The trigger switch according to claim 6, wherein a maximum angle of inclination allowed by the clearance between the first end of the operating shaft and the contact drive member is not less than 1° but not more than 5°.

* * * * *